US006603446B1

(12) United States Patent
Kanazawa et al.

(10) Patent No.: US 6,603,446 B1
(45) Date of Patent: Aug. 5, 2003

(54) PLASMA DISPLAY DEVICE

(75) Inventors: Yoshikazu Kanazawa, Kawasaki (JP); Takeshi Kuwahara, Kawasaki (JP); Haruo Koizumi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/160,292

(22) Filed: Sep. 25, 1998

(30) Foreign Application Priority Data

May 19, 1998 (JP) ..... 10-136920

(51) Int. Cl.[7] ..... G09G 3/28

(52) U.S. Cl. ..... 345/60; 345/62; 345/64; 345/65; 345/63; 345/66; 345/67; 345/68; 345/69; 345/205; 345/206

(58) Field of Search ..... 345/60, 62, 63, 345/64, 65, 66, 67, 68, 69, 205, 206

(56) References Cited

U.S. PATENT DOCUMENTS

| | | | | |
|---|---|---|---|---|
| 4,072,937 A | | 2/1978 | Chu | |
| 4,189,729 A | | 2/1980 | Baker et al. | |
| 5,270,693 A | * | 12/1993 | Wyler et al. | 345/206 |
| 5,420,602 A | * | 5/1995 | Kanazawa | 345/67 |
| 5,835,072 A | * | 11/1998 | Kanazawa | 345/60 |

(List continued on next page.)

FOREIGN PATENT DOCUMENTS

| | | |
|---|---|---|
| EP | 0762373 | 3/1997 |
| JP | 9-160525 | 6/1997 |

OTHER PUBLICATIONS

Patent Abstracts of Japan, vol. 98, No. 5, Apr. 30, 1998 (Mar. 3, 1998) & JP 10 026956 A (Victor Co of Japan) Jan. 27, 1998.

*Primary Examiner*—Richard Hjerpe
*Assistant Examiner*—Jean Lesperance
(74) *Attorney, Agent, or Firm*—Staas & Halsey LLP

(57) ABSTRACT

Disclosed is a configuration of a PDP in which different sustaining discharge signals are applied to odd-numbered ones of X electrodes and Y electrodes and even-numbered ones thereof respectively. Owing to the configuration, the wiring in a drive circuit for driving the X electrodes or Y electrodes is simplified, and a scan driver can be formed with an IC or ICs. A plasma display device has a display panel including first to third electrodes. Sustaining discharge signals that are mutually out of phase are applied alternately to adjoining ones of the first electrodes and adjoining ones of the second electrodes respectively. Consequently, first display cells are defined between the second electrodes and the first electrodes on one side of the second electrodes, and second display cells are defined between the second electrodes and the first electrodes on the other side of the second electrodes. Interlacing where the first display cells and second display cells are allowed alternately and repeatedly to glow for display is carried out. A drive circuit for driving the second electrodes includes a first drive circuit for outputting a pulsating voltage to be applied to the odd-numbered second electrodes, a second drive circuit for outputting a pulsating voltage to be applied to the even-numbered second electrodes, and third circuits associated with the second electrodes for applying the pulsating voltages, which are output from the first drive circuit and second drive circuit, to the second electrodes, and for applying a scanning signal selectively to the second electrodes. In the plasma display device, the third circuits are grouped into third odd circuits to be connected to the odd-numbered ones of the second electrodes, and third even circuits to be connected to the even-numbered ones of the second electrodes. The third odd circuits are integrated into at least one chip, and the third even circuits are integrated into at least one chip.

11 Claims, 14 Drawing Sheets

U.S. PATENT DOCUMENTS 5,889,501 A * 3/1999 Sasaki et al. ..... 345/60
5,898,414 A * 4/1999 Awamoto et al. ..... 345/55
6,034,657 A * 3/2000 Tokunaga et al. ..... 345/60
6,084,558 A * 7/2000 Setoguchi et al. ..... 345/60
6,144,349 A * 11/2000 Awata et al. ..... 345/67
6,160,529 A * 12/2000 Asao et al. ..... 345/60
6,288,692 B1 * 9/2001 Kanazawa et al. ..... 345/67

* cited by examiner

PLASMA DISPLAY DEVICE

BACKGROUND OF THE INVENTION

1. Field of the Invention

The present invention relates to a technology for driving a display panel composed of a set of cells that are display elements having a memory function. More particularly, this invention is concerned with a device for displaying an image on an alternating current (AC) type plasma display panel (PDP) with interlaced scanning.

2. Description of the Related Art

An AC type PDP sustains discharge by applying a voltage waveform alternately to two sustaining electrodes, and glows for display. One discharge completes in one to several microseconds immediately after application of a pulse. Positively charged ions that are derived from the discharge are accumulated on the surface of an insulating layer over electrodes to which a negative voltage is applied. Likewise, electrons carrying negative charges are accumulated on the surface of the insulating layer over electrodes to which a positive voltage is applied.

Discharge is effected with a high-voltage (writing voltage) pulse (writing pulse) in order to generate a wall charge. Thereafter, a pulse (retaining discharge pulse) of a voltage of opposite polarity (retaining discharge voltage), which is lower than the previous voltage, is applied. The accumulated wall charge is added to the voltage. The voltage in a discharge space therefore rises and exceeds the threshold value of a discharge voltage. Eventually, discharge starts. Display cells have the feature that once a display cell is discharged for writing and produces a wall charge, when sustaining discharge pulses of opposite polarities are applied alternately to the display cell, the display cell sustains discharge. This feature is called a memory effect or memory function. In general, the AC type PDP utilizes the memory effect to achieve display.

In an AC type PDP of a prior art, X electrodes that are one set of sustaining electrodes and Y electrodes that are the other set thereof are arranged alternately. Discharge occurs in regions between odd-numbered X electrodes and Y electrodes, and in regions between even-numbered X electrodes and Y electrodes. In other words, display cells are defined between the odd-numbered X electrodes and Y electrodes, and between the even-numbered X electrodes and Y electrodes. No display cell is defined between the odd-numbered Y electrodes and even-numbered X electrodes and between the odd-numbered X electrodes and even-numbered Y electrodes. However, this poses a problem of difficulty in attaining high definition and high luminance. The present applicant has disclosed a PDP for interlaced scanning and a driving method thereof in Japanese Unexamined Patent Publication No. 9-160525. The driving method is called an ALiS method (Alternate Lighting of Surfaces Method) and the PDP of this type is called an ALiS PDP. In the ALiS PDP, display cells are defined even by the odd-numbered Y electrodes and even-numbered X electrodes and by the odd-numbered X electrodes and even-numbered Y electrodes. Thus, high definition and high luminance are ensured. The present invention is adapted to an ALiS plasma display panel (PDP) in which, similarly to the one disclosed in the Japanese Unexamined Patent Publication No. 9-160525, regions defined by a Y electrode and X electrodes across the Y electrode are discharged in order to define display cells.

In the PDP of the prior art, a scan driver is formed with an IC mounted on one chip or ICs mounted on several chips in order to realize a compact design or reduced manufacturing cost. The scan driver is provided with a circuit for generating a scanning pulse as mentioned above. If the scan driver is not formed with an IC, the scan driver as well as the circuit must be composed of discrete parts. A problem arises in terms of circuit scale or cost. Even in the PDP to which the present invention is adapted, a scan driver should preferably be formed with an IC in order to realize a compact design and reduce manufacturing cost. However, a problem underlies the PDP to which the present invention is adapted. Namely, the wiring in a drive circuit for driving the X electrodes or Y electrodes is complex. There is therefore difficulty in forming the scan driver with an IC.

SUMMARY OF THE INTENTION

An object of the present invention is to simplify the wiring in a drive circuit for driving X electrodes or Y electrodes in a PDP in which different sustaining discharge signals are applied to odd-numbered and even-numbered X electrodes and Y electrodes respectively, and to permit formation of a scan driver with an IC.

To accomplish the above object, in a plasma display device of the present invention, a scan driver is divided into a circuit connected to odd-numbered Y electrodes and a circuit connected to even-numbered Y electrodes. Owing to this configuration, only one kind of sustaining discharge signal is present in a chip. A problem concerning durability to a high voltage will not occur. The scan driver can be formed with an IC. Moreover, similarly to the drive circuit for driving the Y electrodes, a drive circuit for driving X electrodes is divided into a circuit connected to odd-numbered X electrodes and a circuit connected to even-numbered X electrodes.

To be more specific, the plasma display device of the present invention has a display panel including first and second electrodes arranged in parallel with one another, and third electrodes arranged orthogonally to the first and second electrodes. With a scanning signal and addressing signal to be applied to the second and third electrodes, discharge cells are selected. By applying sustaining discharge signals to the first and second electrodes respectively, the selected cells sustain a discharge. The sustaining discharge signals that are mutually out of phase are applied alternately to a pair of adjoining first electrodes and a pair of adjoining second electrodes. Consequently, first display cells are defined between the second electrodes and the first electrodes on one side of the second electrodes. Second display cells are defined between the second electrodes and the first electrodes on the other side of the second electrodes. Interlacing, where the first display cells and second display cells are allowed to glow alternately and repeatedly, is carried out. A drive circuit for driving the second electrodes in the plasma display device includes a first drive circuit for outputting a pulsating voltage to be applied in common to the odd-numbered ones of the second electrodes, a second drive circuit for outputting a pulsating voltage to be applied in common to the even-numbered ones of the second electrodes, and third circuits associated with the second electrodes for applying the pulsating voltages output from the first drive circuit and second drive circuit to the second electrodes and for applying a scanning signal selectively to the second electrodes. In the plasma display device, the third circuits are grouped into third odd circuits connected to the odd-numbered ones of the second electrodes, and third even circuits connected to the even-numbered ones of the second electrodes. The third odd circuits are integrated into at least one chip and the third even circuits are integrated into at least one chip.

In the plasma display device of the present invention, the drive circuit for driving the second (Y) electrodes is divided into the circuit connected to the odd-numbered Y electrodes and the circuit connected to the even-numbered Y electrodes. This leads to improved freedom in wiring. Moreover, when the third odd circuits and third even circuits are formed with ICs, only one kind of sustaining discharge signal is present within one chip. No problem will therefore occur in relation to durability to a high voltage.

For arranging the foregoing circuits, preferably, the chip having the third odd circuits is located near the first circuit, and the chip having the third odd circuits is located near the second circuit.

For matching the orders of output from the chips having the third odd circuits and third even circuits with the order of arrangement of the Y electrodes, an arrangement changing means is included for modifying a wiring pattern on a circuit board or routing of cables.

When a plurality of first circuits and a plurality of second circuits are included, the first circuits and second circuits should preferably be arranged alternately. Furthermore, when the third odd circuits and third even circuits are each formed with a plurality of chips, the chips should preferably be arranged alternately while being associated with the first circuits and second circuits.

A selection voltage and non-selection voltage, to be used during scanning, are shared by the first and second circuits. A fourth circuit may be included for supplying the voltages.

At least a current supply line and current return line are laid between the first circuit and third odd circuits and between the second circuit and third even circuits.

The fourth circuit includes a first switching element for applying a selection voltage, first and second diodes connected to the first switching element, a second switching element for applying a non-selection voltage, and third and fourth diodes connected to the second switching element. The first diode is connected to one terminal of each of the third odd circuits, and the third diode is connected to the other terminals of the third odd circuits. The second diode is connected to one terminal of each of the third even circuits, and the fourth diode is connected to the other terminals of the third even circuits.

The first and second circuits each include at least a switching element for supplying a sustaining discharge voltage and a switching element for supplying a voltage to be selectively applied to the second electrodes at the time of application of the scanning signal.

The first circuit and the chip having the third odd circuits are mounted on one side of a substrate, and the second circuit and the chip having the third even circuits are mounted on the other side thereof. This leads to simple wiring. Moreover, the chip having the third odd circuits may be mounted on one side of a substrate and the chip having the third even circuits may be mounted on the other side thereof. The first and second circuits may be mounted on one side of the substrate or the other side thereof.

Output terminals on the chip having the third odd circuits and those on the chip having the third even circuits, through which a scanning signal is output sequentially, should preferably be arranged so that the scan signal will be output sequentially in the same direction with respect to one side of the substrate. Thus, the arrangement should preferably be matched with the arrangement of the Y electrodes in the panel.

Moreover, according to another aspect of the present invention, there is provided a plasma display device having a display panel in which first and second electrodes are arranged in parallel with one another, and third electrodes are arranged orthogonally to the first and second electrodes. According to a scanning signal and addressing signal to be applied to the second and third electrodes, a discharge cell is selected. By applying sustaining discharge signals to the first and second electrodes, the selected discharge cell is caused to sustain discharge. In the plasma display device, sustaining discharge signals that are mutually out of phase are applied alternately to the first adjoining electrodes and the second adjoining electrodes. Consequently, first display cells are defined between the second electrodes and the first electrodes on one side of the second electrodes, and second display cells are defined between the second electrodes and the first electrodes on the other side of the second electrodes. Interlacing where the first display cells and second display cells are allowed to glow for display alternately and repeatedly is thus carried out. A drive circuit for driving the first electrodes in the plasma display device includes a fifth drive circuit for outputting a pulsating voltage to be applied in common to the odd-numbered ones of the first electrodes, and a sixth drive circuit for outputting a pulsating voltage to be applied in common to the even-numbered ones of the first electrodes. Pluralities of fifth circuits and sixth circuits are included and arranged alternately.

The fifth and sixth circuits each include at least a switching element for supplying a sustaining discharge voltage and a switching element for supplying a voltage to be applied selectively to the first electrodes at the time of application of the scanning signal.

The fifth circuits are mounted on one side of a substrate, and the sixth circuits are mounted on the other side thereof. This leads to simple wiring.

BRIEF DESCRIPTION OF THE DRAWINGS

The present invention will be more clearly understood from the description as set below with reference to the accompanying drawings, wherein.

DESCRIPTION OF THE PREFERRED EMBODIMENTS

Before proceeding to a detailed description of the preferred embodiments, a plasma display apparatus to which the present invention is applied and problems in realizing the plasma display apparatus will be described with reference to the accompanying drawings for a clearer understanding of the differences between the prior art and the present invention.

Figure 1:
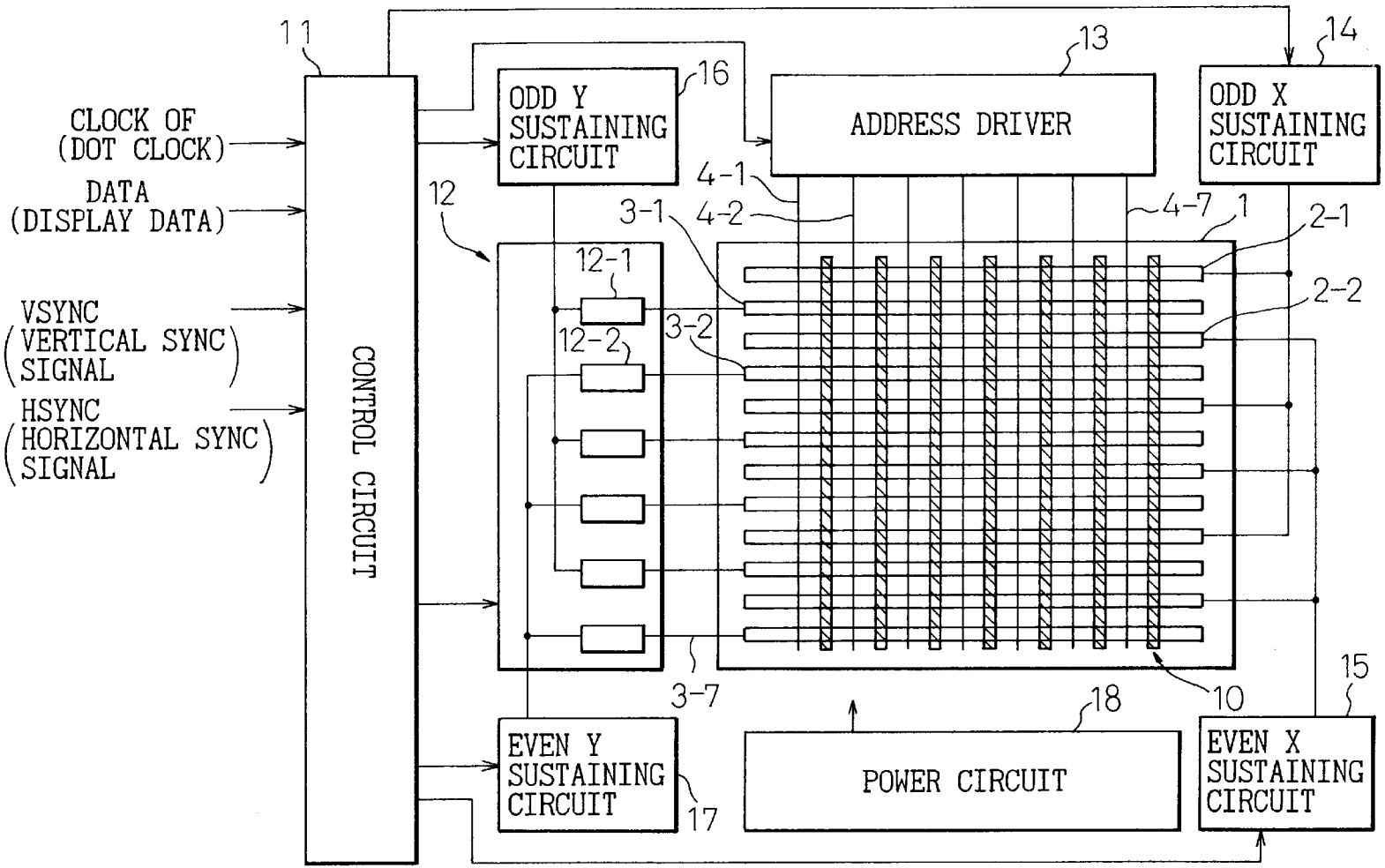
FIG. 1 is a block diagram showing a configuration of a plasma display panel (PDP) to which the present invention is adapted.
Figure 2:
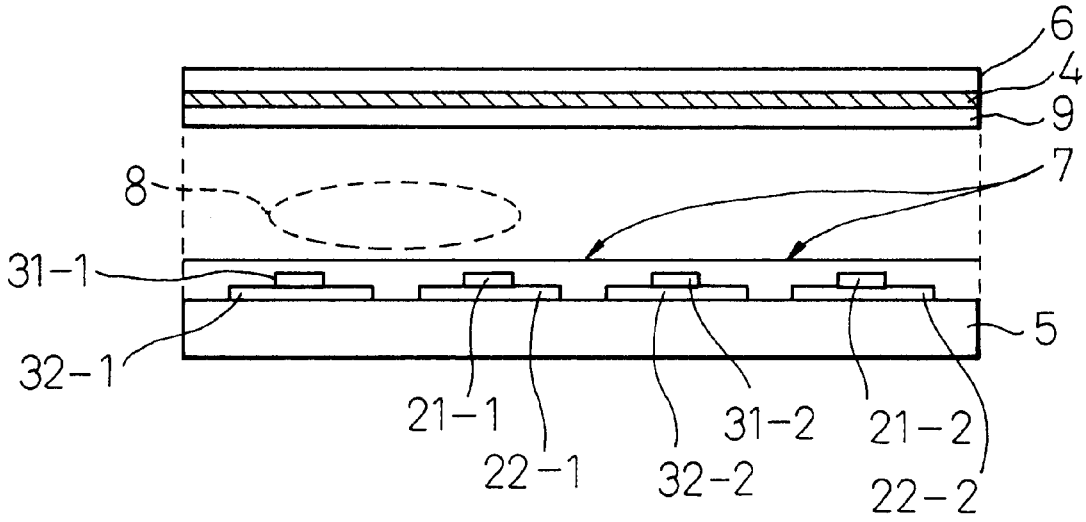
FIG. 2 is a diagram showing a cross sectional structure of the panel shown in FIG. 1.
Figure 3:
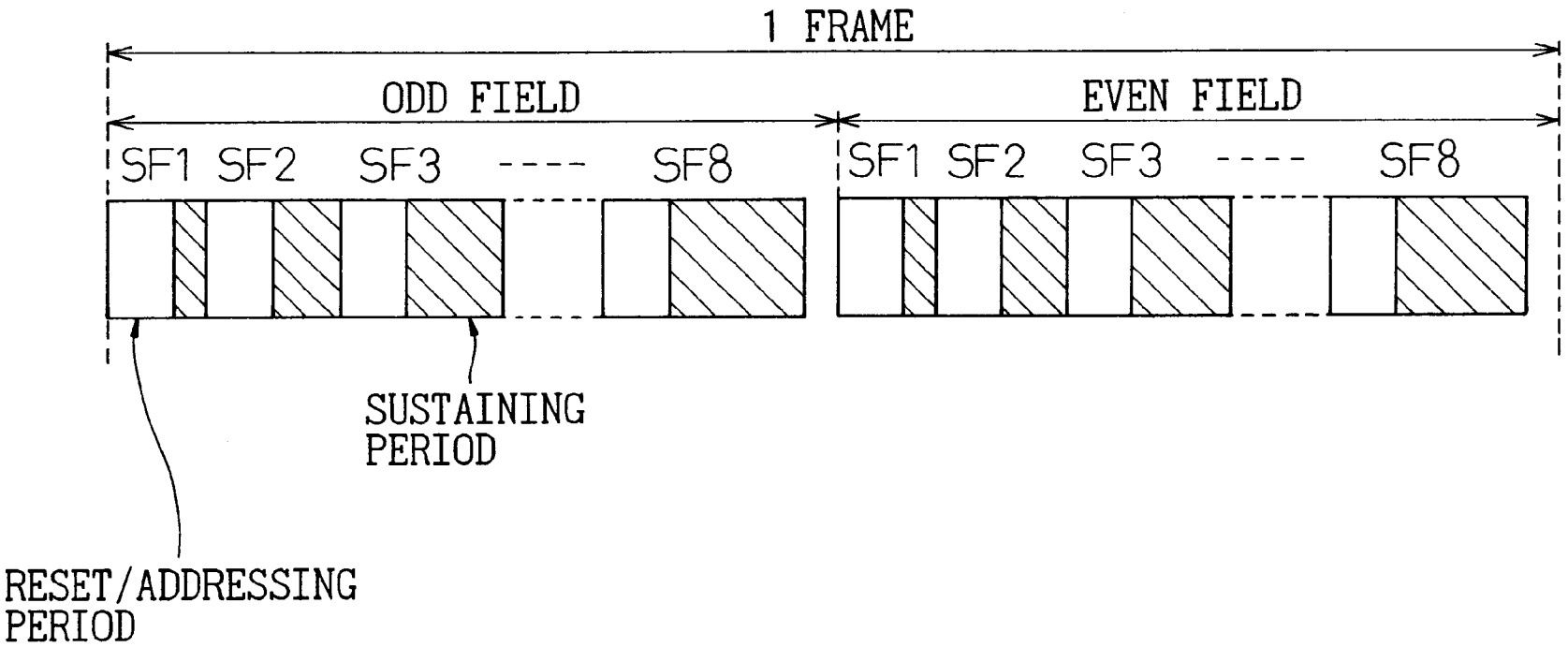
FIG. 3 is a diagram showing a structure of a display frame employed in the PDP shown in FIG. 1.
Figure 4:
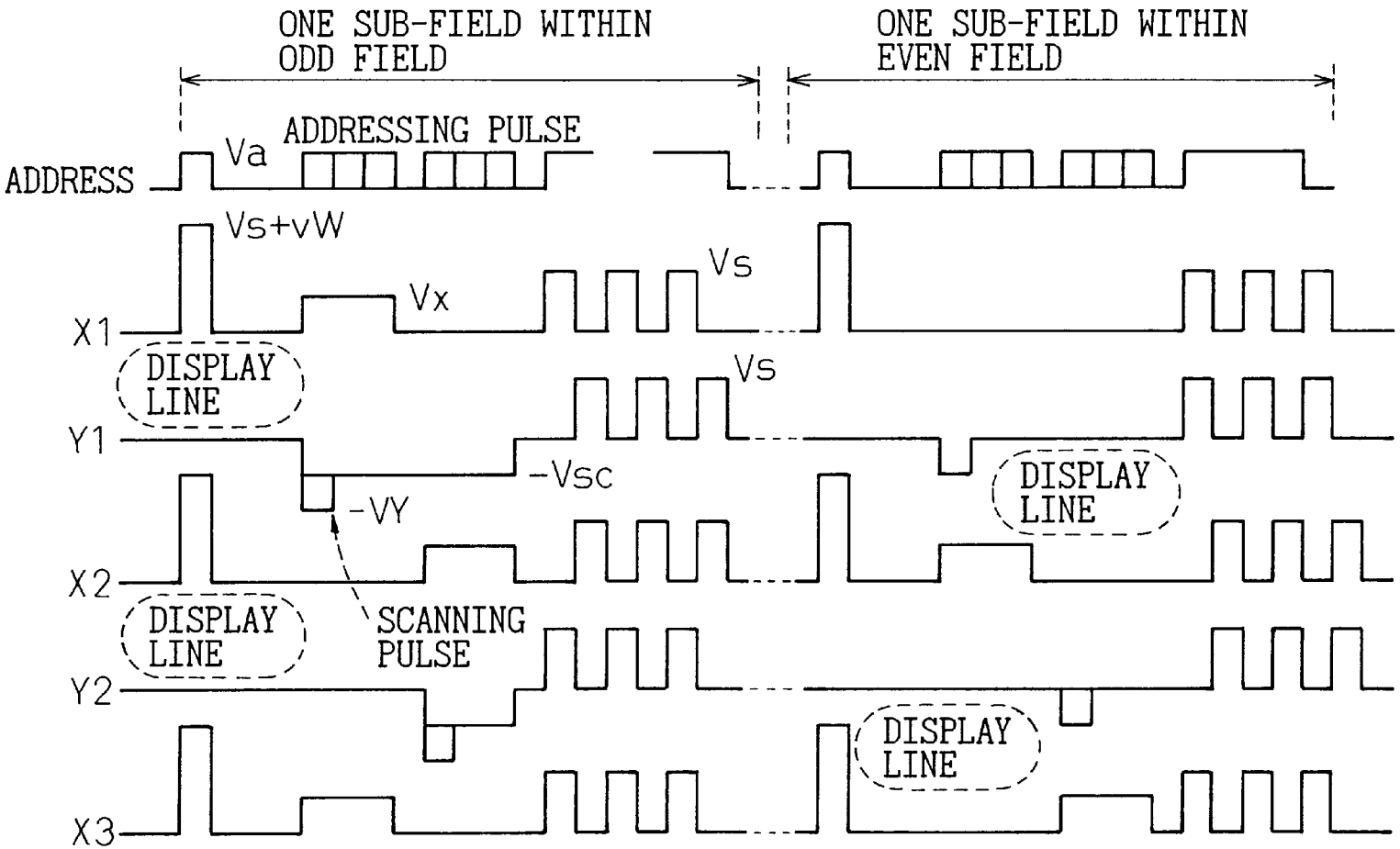
FIG. 4 is a timing chart showing waveforms of driving signals employed in the PDP shown in FIG. 1.

FIG. 1 is a block diagram showing an overview of a PDP disclosed in Japanese Unexamined Patent Publication No. 9-160525. FIG. 2 shows a cross sectional structure of the panel. FIG. 3 is a diagram showing a structure of one frame. FIG. 4 is a timing chart showing waveforms of driving signals to be applied to electrodes during one sub-field. Referring to these drawings, the PDP to which the present invention is adapted will be described.

As shown in FIG. 1, a panel 1 is provided with first electrodes (X electrodes) 2-1, 2-2, etc., second electrodes (Y electrodes) 3-1, 3-2, etc., which act as sustaining discharge electrodes, and address electrodes 4-1, 4-2, etc. As shown in FIG. 2, the panel 1 is composed of two glass substrates 5 and 6. On the first substrate 5, transparent electrodes 22-1, etc. and bus electrodes 21-1, etc. constituting the X electrodes, and transparent electrodes 32-1, 32-2, etc. and bus electrodes 31-1, 31-2, etc. constituting the Y electrodes are arranged alternately in parallel with one another. The substrate 5 provides a display surface. The transparent electrodes are used for transmitting light reflected from phosphors 9. However, employment of the transparent electrodes alone will lead to a large voltage drop. The bus electrodes are therefore included in order to prevent a voltage drop caused by an electrode resistance. Furthermore, these electrodes are coated with a dielectric. A magnesium oxide (MgO) film is formed as a protective film over a discharge surface.

Moreover, the address electrodes 4 are formed on the glass substrate 6 opposed to the glass substrate 5 in such a manner that they are orthogonal to the X and Y electrodes. Furthermore, a barrier 10 is formed between adjoining address electrodes. Phosphors 9 exhibiting a characteristic of emitting red, green, and blue light rays are formed between adjoining barriers, so that each phosphor 9 will cover each address electrode. The two glass substrates 5 and 6 are assembled by attaching the ridges of the barriers 10 closely to the MgO film.

Each electrode is discharged to release a charge to gaps 8 (that is, discharge slits) across the electrode. The Y electrodes are utilized mainly for selecting a display line during an addressing operation and triggering sustaining discharge. The address electrodes are utilized mainly for triggering addressing discharge intended to select a display cell from among those defined by a Y electrode coincident with the selected display line. The X electrodes are utilized mainly for selecting to which of the discharge slits across the selected Y electrode a charge should be released for addressing discharge during the addressing operation, and for triggering sustaining discharge.

As shown in FIG. 1, the address electrodes 4-1, 4-2, etc. are connected to an address driver 13 one by one. The address driver 13 applies an addressing pulse during addressing discharge. The Y electrodes are connected individually to a scan driver 12. The scan driver 12 is divided into a portion for driving the odd Y electrodes 31, 3-3, etc. and a portion for driving the even Y electrodes 3-2, 3-4, etc. The portion for driving the odd Y electrodes is connected to an odd Y sustaining circuit 16 and the portion for driving the even Y electrodes is connected to an even Y sustaining circuit 17. A pulse to be applied for an addressing operation is generated by the scan driver 12. A sustaining discharge pulse or the like is generated by the odd Y sustaining circuit 16 and even Y sustaining circuit 17, and applied to each Y electrode via the scan driver 12. The X electrodes 2-1, 2-2, etc. are grouped into the odd X electrodes 2-1, 2-3, etc., and the even X electrodes 2-2, 2-4, etc. The groups are connected to an odd X sustaining circuit 14 and even X sustaining circuit 15 respectively. These drivers are controlled by a control circuit 11. The control circuit is controlled with a synchronizing (hereinafter sync) signal and a display data signal which are input externally.

As shown in FIG. 3, a driving sequence for one frame employed in the foregoing PDP is divided into a driving sequence for an odd field and that for an even field. During the-odd field, odd lines are displayed. During the even field, even lines are displayed. In other words, during the odd field, regions defined between the odd-numbered X electrodes and Y electrodes and between the even-numbered X electrodes and Y electrodes are discharged. During the even field, regions defined between the odd-numbered Y electrodes and even-numbered X electrodes, and between the odd-numbered X electrodes and even-numbered Y electrodes are discharged. Moreover, each field is divided into sub-fields. In FIG. 3, each field is divided into eight sub-fields SF1, SF2, etc., and SF8. Each sub-field is composed of a reset period during which display cells are initialized, an addressing period during which display data is written (addressing), and a sustaining period during which cells in which a wall charge is accumulated due to addressing are discharged repeatedly (sustaining discharge) to glow. During the odd field, addressing discharge and sustaining discharge are carried out for odd lines alone. During the even field, addressing discharge and sustaining discharge are carried out for even lines alone. The luminance of display is determined by the length of the sustaining discharge period, that is, the number of sustaining discharge pulses.

Among the sub-fields SF1, SF2, etc., and SF8, the reset periods and addressing periods have the same lengths. However, the ratio of the lengths of the sustaining discharge periods is 1:2:4:8:16:32:64:128. Depending on what sub-fields during which a display cell is lit are selected, a difference in luminance can be exhibited in 256 steps ranging from level 0 to level 255.

FIG. 4 is a timing chart showing the waveforms of driving signals employed in the plasma display device shown in FIG. 1 for one sub-field. In this example, one sub-field is divided into a reset/addressing period and a sustaining discharge period (sustaining period). During the reset period, first, all the Y electrodes are set to 0 V. At the same time, a whole-screen writing pulse of a voltage calculated by adding up voltages Vs and Vw (approximately 300 V) is applied-to the X electrodes. This reset operation has an effect of bringing all the display cells to the same state irrespective of their being or not being lit during the previous sub-field. The reset operation is therefore carried out in order to stabilize subsequent addressing discharge (writing).

Thereafter, during the addressing period, addressing discharge is carried out line-sequentially in order to turn on or off the display cells according to display data. In a conventional PDP, the same voltage is applied to all X electrodes, and a scanning pulse is applied sequentially to Y electrodes. In the PDP shown in FIG. 1, a different operation is carried out, and the addressing period is divided into a first-half addressing period and second-half addressing period. For example, during the first-half addressing period within the odd field, any of the display cells constituting the first line, fifth line, etc. are addressed. During the second-half addressing period, any of the display cells constituting the third line, seventh line, etc. are addressed. During the first-half addressing period within the even field, any of the display cells constituting the second line, sixth line, etc. are addressed. During the second-half addressing period, any of the display cells constituting the fourth line, eighth line, etc. can be addressed.

To begin with, during the first-half addressing period within the odd field, a voltage Vx (approximately 50 V) is applied to the first, third, and other odd-numbered X electrodes. A voltage of 0 V is applied to the second, fourth, and other even-numbered X electrodes. A scanning pulse (−VY: −150 V) is applied to the first, third, and other odd-numbered Y electrodes. At this time, a voltage of 0 V is applied to the second, fourth, and other even-numbered Y electrodes. Also, an addressing pulse of a voltage Va (approximately 50 V) is applied selectively to the address electrodes. Consequently, discharge occurs in regions or display cells, which are to be lit, defined between the address electrodes and an Y electrode. Thereafter, the discharge acts as a primer to cause discharge in regions defined between the X electrode and Y electrode. At this time, the voltage Vx has been applied to the odd-numbered X electrodes, and the voltage of 0 V has been applied to the even-numbered X electrodes. The discharge therefore occurs in the regions or discharge slits at the side of an odd-numbered X electrode to which the voltage Vx has been applied. Consequently, a wall charge enabling sustaining discharge is accumulated on the MgO film over the X electrode and Y electrode defining the selected cells constituting a selected line. When the foregoing operation is repeated until the last Y electrode is processed, any of the display cells constituting the first, fifth, etc. lines can be addressed.

Thereafter, the voltage Vx (approximately 50 V) is applied to the second, fourth, and other even-numbered X electrodes during the second-half addressing period within the odd field. The voltage of 0 V is applied to the first, third, and other odd-numbered X electrodes. Any of display cells constituting the third and seventh lines and others can be addressed. This way, addressing any of the display cells constituting the first, third, fifth, and other odd-numbered lines is completed during the first-half and second-half addressing periods within the odd field.

Thereafter, during the sustaining discharge period, a sustaining pulse of a voltage Vs (approximately 180 V) is applied alternately to the Y electrodes and X electrodes. This triggers a sustaining discharge. An image for one sub-field within the odd field is then displayed. At this time, a voltage to be applied to the odd-numbered X electrodes and Y electrodes and a voltage to be applied to the even-numbered X electrodes and Y electrodes are mutually out of phase. A potential difference Vs is produced between an odd-numbered X electrode and Y electrode surrounding odd-numbered discharge slits, and between an even-numbered X electrode and Y electrode surrounding odd-numbered discharge slits. However, the potential difference Vs is not produced between an odd-numbered X electrode and an even-numbered Y electrode which surround even-numbered discharge slits and between an even-numbered X electrode and an odd-numbered Y electrode which surround even-numbered discharge slits. Consequently, sustaining discharge is carried out in odd-numbered display cells alone.

Likewise, during an even field, an image is displayed by means of the even-numbered display cells. As mentioned above, display cells are defined between an Y electrode and the X electrodes across the Y electrode. Although the structure of the panel is similar to the one of a prior art, a higher-definition display can be achieved.

Figure 5:
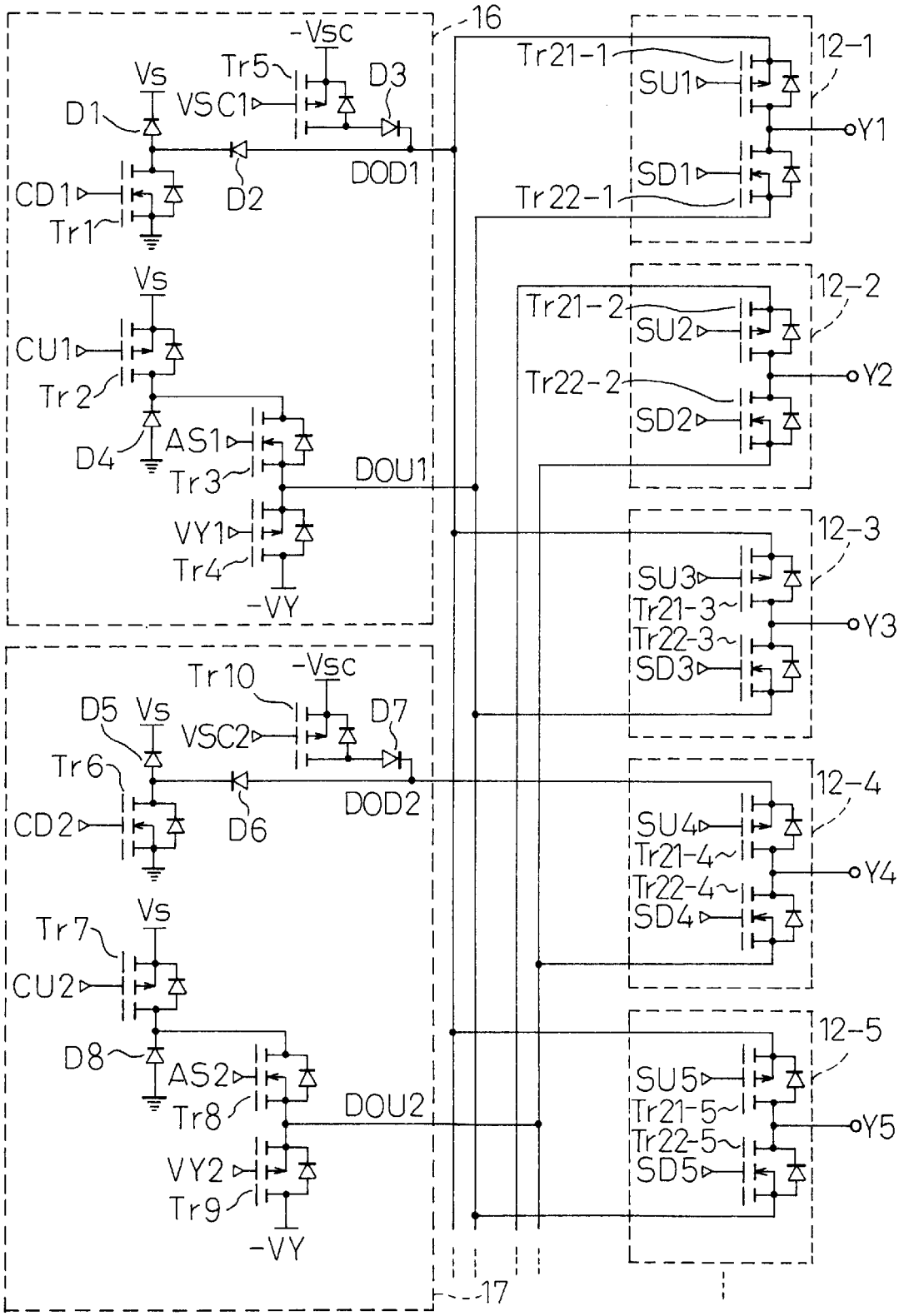
FIG. 5 is a diagram showing a configuration of a second (Y) electrode drive circuit in accordance with a prior art.

FIG. 5 is a diagram showing the circuitry of a portion including the odd Y sustaining circuit 16, even Y sustaining circuit 17, and scan driver 12 of the PDP shown in FIG. 1. The scan driver 12 is provided with a circuit for generating a scanning pulse in response to a sync signal sent from the control circuit 11, though the circuit is not illustrated. The odd Y sustaining circuit 16 and even Y sustaining circuit 17 have the same configuration. Namely, each of the odd and even Y sustaining circuits comprises: field-effect transistors (FETs) (hereinafter referred to as simply transistors) Tr1 and Tr6 to which signals CD1 and CD2 used to route a discharge current to the ground GND are applied through the gates thereof; transistors Tr2 and Tr7 to which signals CU1 and CU2 used to supply a discharge current from a Vs source are applied through the gates thereof; transistors Tr4 and Tr9 to which signals VY1 and VY2 used to apply a selection voltage—VY during an addressing operation are applied through the gates thereof; transistors Tr5 and Tr10 to which signals VSC1 and VSC2 used to apply a non-selection voltage—VSC during the addressing operation are applied through the gates thereof; and transistors Tr3 and Tr8 to which signals AS1 and AS2 used to separate the transistors Tr2 and Tr7 during the addressing operation are applied through the gates thereof.

On the other hand, the scan driver 12 comprises individual drivers 12-1, 12-2, etc. that are provided in the same number as the number of electrodes, and that are composed of transistors Tr21-1, Tr21-2, etc. which are associated with the electrodes and to which signals SU1, SU2, etc. are applied through the gates thereof, and transistors Tr22-1, Tr22-2, etc. which are associated with the electrodes and to which signals SD1, SD2, etc. are applied through the gates thereof. These drivers 12-1, 12-2, etc., which are associated with the odd electrodes and even electrodes, are connected in common to terminals DOD1 and DOU1 of the odd Y sustaining circuit 16 and terminals DOD2 and DOU2 of the even Y sustaining circuit 17.

The operations of the circuits shown in FIG. 5 will be described briefly. A sustaining discharge pulse (sustaining pulse) is applied from the Vs source to the Y electrodes in the panel by way of the transistors Tr2, Tr3, Tr22-1, Tr22-2, etc. A discharge current flows through the same path. Moreover, the pulse is removed from the Y electrodes to the ground GND by way of the diodes of the transistors Tr21-1, Tr21-2, etc., a diode D2, and the transistor Tr1. At this time, a Vs pulse is applied to the X electrodes. A sustaining discharge current flows through the same path.

During addressing discharge, the transistors Tr1, Tr2, and Tr2 are turned off, and the transistors Tr5 and Tr4 are turned on. Consequently, a selection potential is developed at one terminal of the scan driver 12 and a non-selection potential is developed at the other terminal thereof. For selecting the Y electrodes, the transistors Tr22-1, Tr22-2, etc. are turned on. For leaving the Y electrodes unselected, the transistors Tr21-1, Tr22-2, etc. are turned on.

The Y electrode drive circuit in the PDP to which the present invention is adapted has been described. The same applies to a circuit for driving the X electrodes except that a scanning pulse is not applied.

In the PDP of the prior art in which it is unnecessary to drive odd-numbered Y electrodes and even-numbered Y electrodes separately, one sustaining circuit is included and one kind of sustaining discharge signal is employed. Only one set of wiring should therefore be laid. The wiring is simple. By contrast, as is apparent from FIG. 5, in the PDP to which the present invention is adapted, the different sustaining circuits are connected alternately to the drivers in the scan driver 12 for directly driving each Y electrode. This poses a problem that the wiring in the circuit becomes complex. Specifically, the drivers in the scan driver 12 must be arranged in order so that outputs of the scan driver 12 can be supplied smoothly to the Y electrodes in the panel 1. For this purpose, two sets of wiring over which sustaining discharge signals are supplied from two sustaining circuits must be laid and the drivers must be connected to the associated sets of wiring. The same applies to the circuit for driving the X electrodes.

In the conventional PDP, the scan driver 12 is formed with an IC mounted on one chip or ICs mounted on several chips in an effort to realize a compact design and reduce manufacturing cost. The scan driver 12 is, as mentioned above, provided with a circuit for generating a scanning pulse. If the scan driver 12 is not formed with an IC or ICs, the circuits including the drivers 12-1, 12-2, etc. shown in FIG. 5 must be realized with discrete parts. A problem arises in the aspect of circuit scale or cost. In the PDP to which the present invention is adapted, the scan driver 12 should preferably be formed with an IC or ICs in order to realize a compact design and reduce manufacturing cost. However, obviously, there is a problem in forming the scan driver with an IC or ICs.

For forming the drivers 12-1, 12-2, etc. in the scan driver 12 shown in FIG. 5 using an IC, the drivers 12-1, 12-2, etc. are arranged in that order in consideration of connections to the panel 1. On a chip, four terminals through which sustaining discharge signals supplied from the two sustaining circuits 16 and 17 are received are formed. Two sets of wiring over which the sustaining discharge signals are supplied to the drivers are juxtaposed within the chip. Since the area of the chip is limited, the two sets of wiring cannot help being arranged somewhat closely. However, as mentioned above, the sustaining discharge signal is approximately 180 V. The signals to be applied to the two sets of wiring are mutually out of phase. The voltage of approximately 180 V is therefore applied to the two sets of wiring as it is. There is therefore a difficulty in arranging the two sets of wiring mutually closely within the chip. This leads to the problem that the scan driver cannot be formed with an IC. Moreover, even when the scan driver can be formed with an IC, the chip must be made large. The manufacturing cost increases accordingly. Incidentally, as long as the sustaining discharge signal is applied over only one set of wiring, a potential difference between points on the wiring derives from only voltage drops occurring at the transistors Tr21-1, Tr21-2, etc. and Tr22-1, Tr22-2, etc. in the drivers 12-1, 12-2, etc. The potential difference is therefore small.

Figure 6:
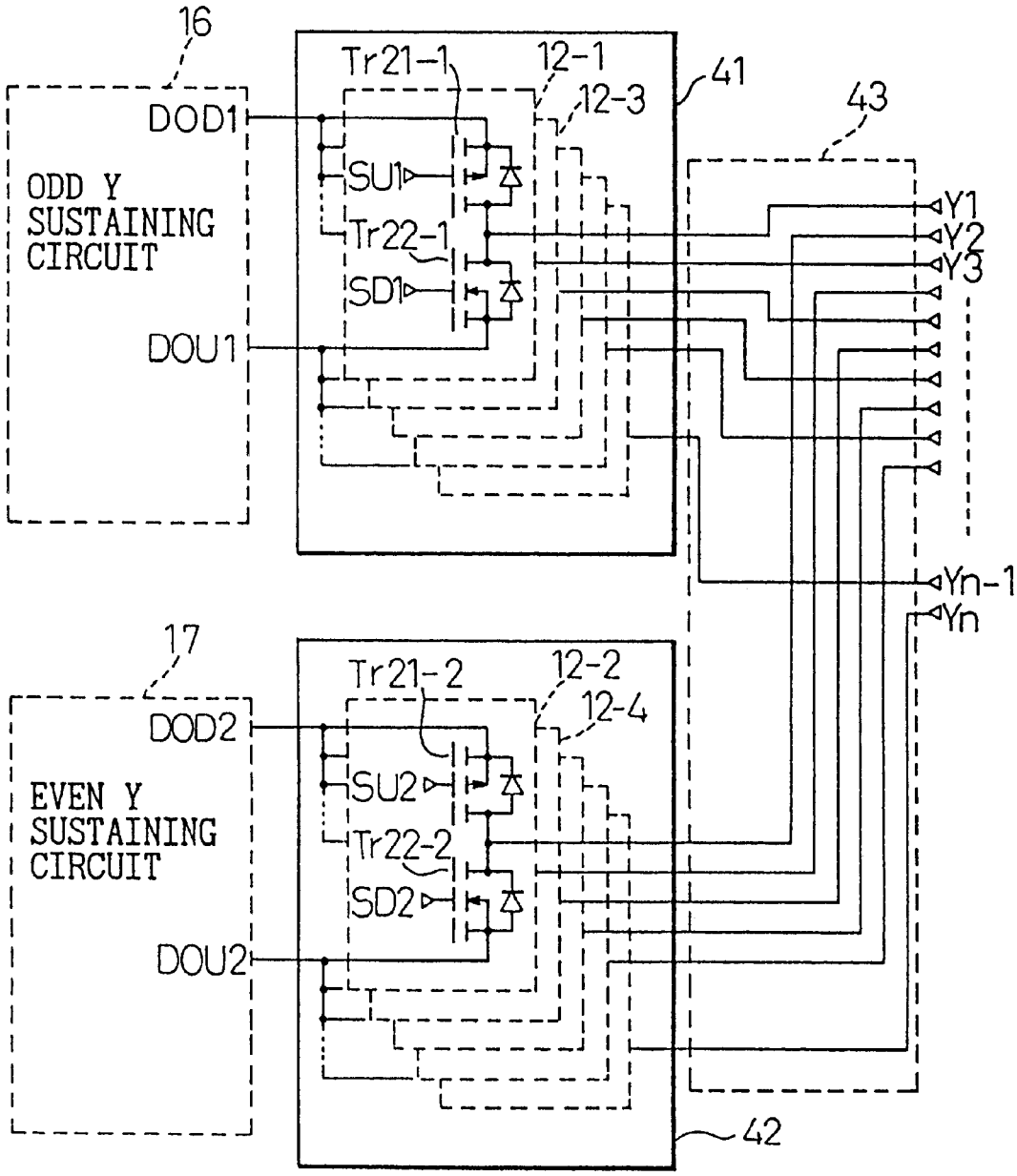
FIG. 6 is a diagram showing a configuration of a Y-electrode drive circuit in the first embodiment of the present invention.

FIG. 6 is a diagram showing the circuitry of a portion including an odd Y sustaining circuit 16, even Y sustaining circuit 17, and scan drivers of a PDP in accordance with the first embodiment of the present invention. The odd Y sustaining circuit 16 and even Y sustaining circuit 17 have the same configuration as those in the prior art shown in FIG. 5. A scan driver 41 is realized with an LSI into which drivers 12-1, 12-3, etc. to be connected to odd-numbered Y electrodes are integrated and which provides multiple outputs. A scan driver 42 is realized with an LSI into which drivers 12-2, 12-4, etc. to be connected to even-numbered Y electrodes are integrated and which provides multiple outputs. The outputs sent from the scan drivers are led out alternately when the scan drivers are connected to the Y electrodes in the panel 1. In reality, a circuit board 43 for converting one array into another is included. The circuit board 43 is provided with a connector to be coupled to the scan drivers 41 and 42 and a connector to be coupled to the panel 1. The order of connection is changed internally. Moreover, a cable may be substituted for the circuit board 43.

Figure 7:
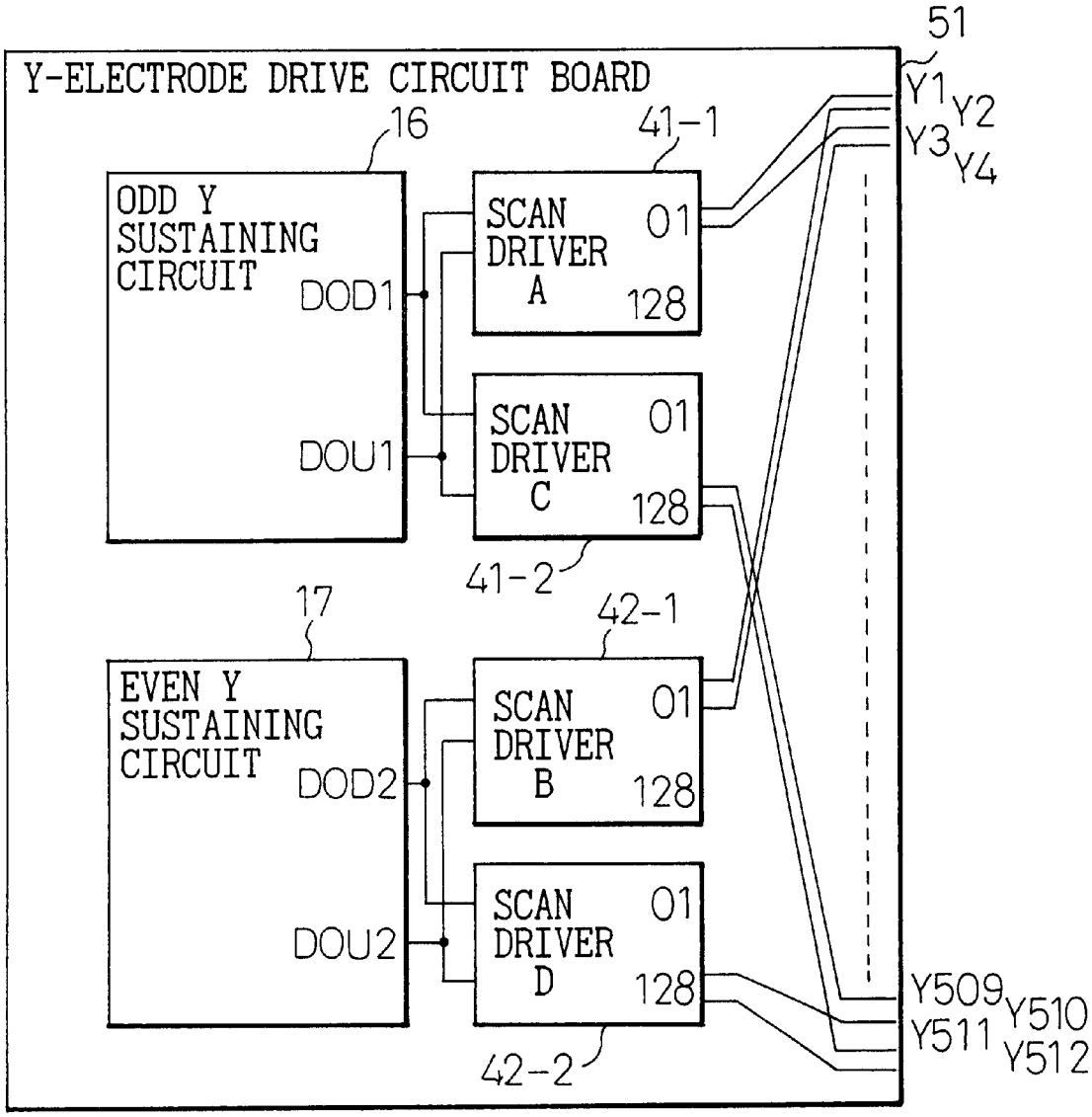
FIG. 7 is a diagram showing a configuration of a Y-electrode drive circuit in the second embodiment of the present invention.

FIG. 7 is a diagram showing the circuitry of a portion including an odd Y sustaining circuit, even Y sustaining circuit, and scan drivers of a PDP in accordance with the second embodiment of the present invention. An odd Y sustaining circuit 16 and even Y sustaining circuit 17 have the same configuration as those in the first embodiment. The scan drivers 41 and 42 in the second embodiment are each composed of two scan drivers, that is, a scan driver A 41-1 and scan driver C 41-2, and a scan driver B 42-1 and scan driver D 42-2. The scan driver A 41-1 is connected to the high-order odd-numbered Y electrodes. The scan driver C 41-2 is connected to the low--order odd-numbered Y electrodes. The scan driver B 42-1 is connected to the high-order even-numbered Y electrodes. The scan driver D 42-2 is connected to the low-order even-numbered Y electrodes. As illustrated, the odd Y sustaining circuit 16, even Y sustaining circuit 17, scan drivers A 41-1, scan drivers C 41-2, scan drivers B 42-1, and scan drivers D 42-2 are mounted on a Y-electrode drive circuit board 51. Moreover, outputs from the Y-electrode drive circuit board 51 are provided in order of arrangement of the Y electrodes. A portion for rearranging outputs of the scan drivers so that the outputs will be provided in the same order as the order of arrangement of the Y electrodes is included. The scan driver A 41-1 and scan driver C 41-2 are located near the odd Y sustaining circuit 16. The scan driver B 42-1 and scan driver D 42-2 are located near the even Y sustaining circuit 17.

Figure 8:
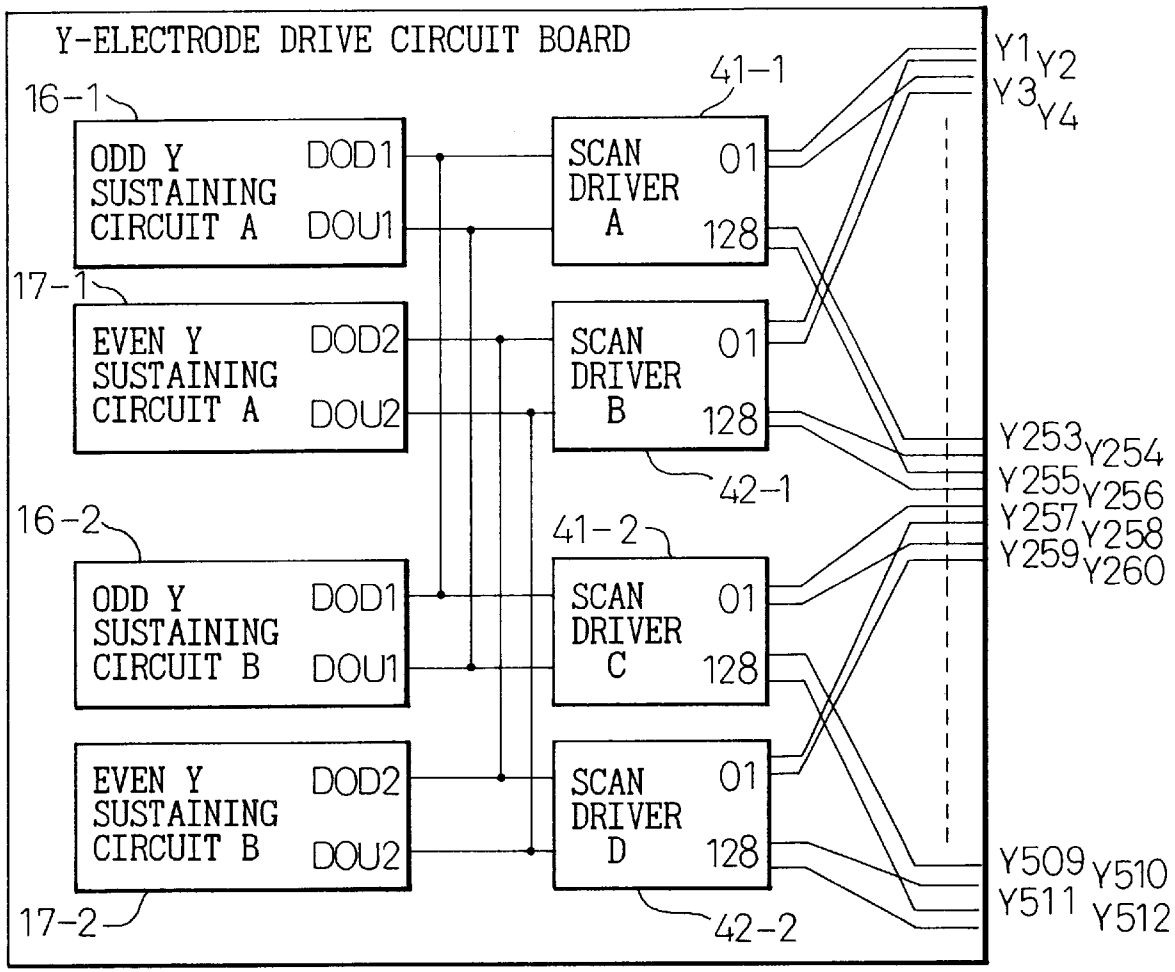
FIG. 8 is a diagram showing a configuration of a Y-electrode drive circuit in the third embodiment of the present invention.

FIG. 8 is a diagram showing the circuitry of a portion including an odd Y sustaining circuit, even Y sustaining circuit, and scan drivers of a PDP in accordance with the third embodiment of the present invention. The circuitry of the third embodiment is identical to that of the second embodiment except that the odd Y sustaining circuit 16 and even Y sustaining-circuit 17 are each composed of two Y sustaining circuits, that is, an odd Y sustaining circuit A 16-1 and even Y sustaining circuit B 17-1, and an odd Y sustaining circuit A 16-2 and even Y sustaining circuit B 17-2. The scan driver A 41-1, scan driver C 41-2, scan-driver B 42-1, and scan driver D 42-2 are located near the odd Y sustaining circuit A 16-1, even Y sustaining circuit A 17-1, odd Y sustaining circuit B 16-2, and even Y sustaining circuit B 17-2 respectively. According to the third embodiment, compared with the first and second embodiments, lines linking an output port of a scan driver to Y electrodes can be made short. This leads to the advantage of a low impedance (resistive component, capacitive component, and inductive component) offered by the line, and the advantage of a reduced voltage drop.

Figure 9:
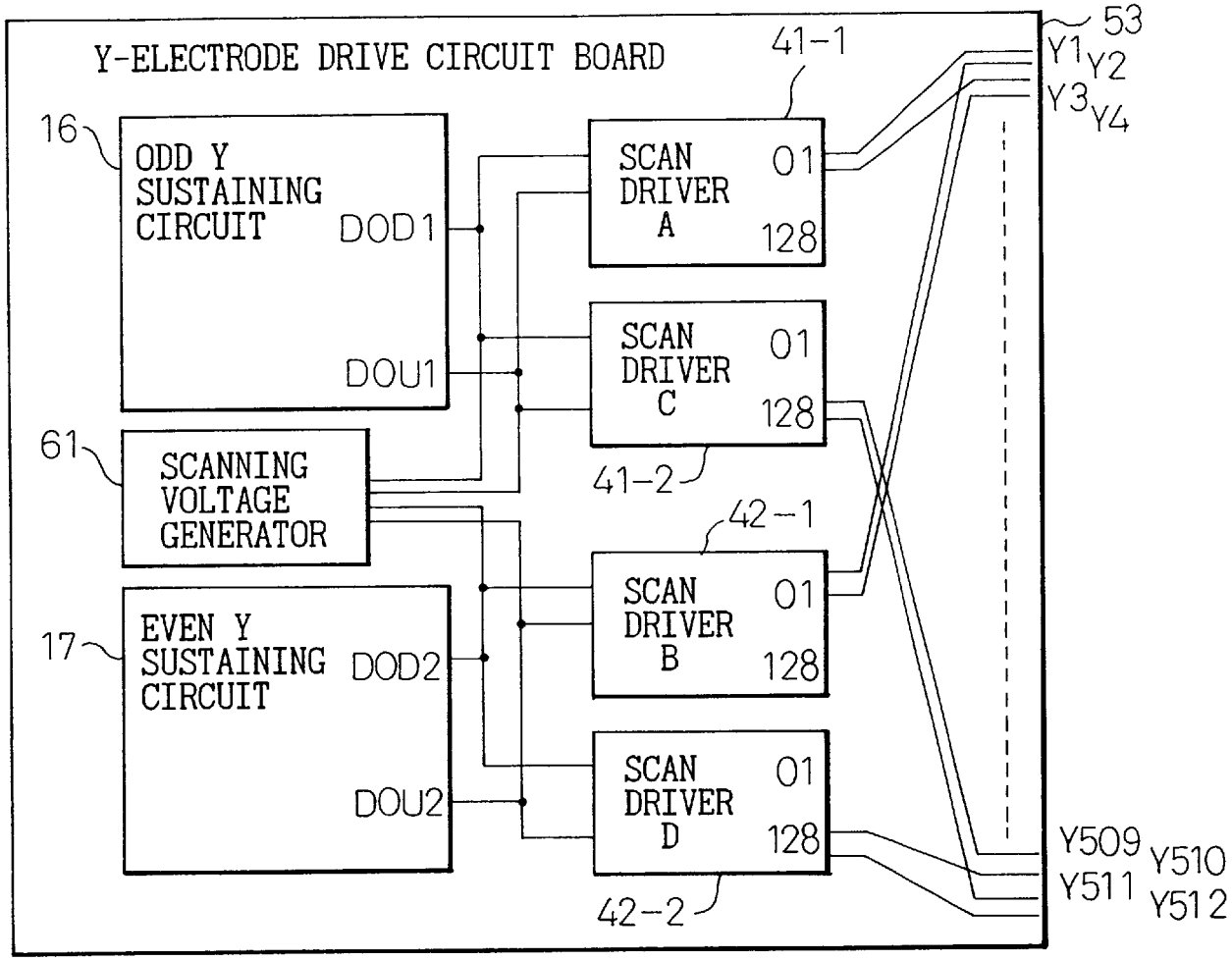
FIG. 9 is a diagram showing a configuration of a Y-electrode drive circuit in the fourth embodiment of the present invention.

FIG. 9 is a diagram showing the circuitry of a portion including an odd Y sustaining circuit, even Y sustaining circuit, and scan drivers of a PDP in accordance with the fourth embodiment of the present invention. The circuitry of the fourth embodiment is identical to that of the second embodiment except that a scan voltage generator 61 is included. As shown in FIG. 4, the waveforms of driving signals to be applied to Y electrodes demonstrate that the driving signals to be applied during a sustaining discharge period are mutually out of phase. During an addressing period, a voltage −Vsc is applied to unselected X and Y electrodes. A voltage −VY is applied to selected X and Y electrodes. A circuit for developing a necessary potential during the addressing period can therefore be used in common. The fourth embodiment therefore includes the scan voltage generator 61. During the addressing period, a voltage generated by the scan voltage generator 61 is supplied to each scan driver.

Figure 10:
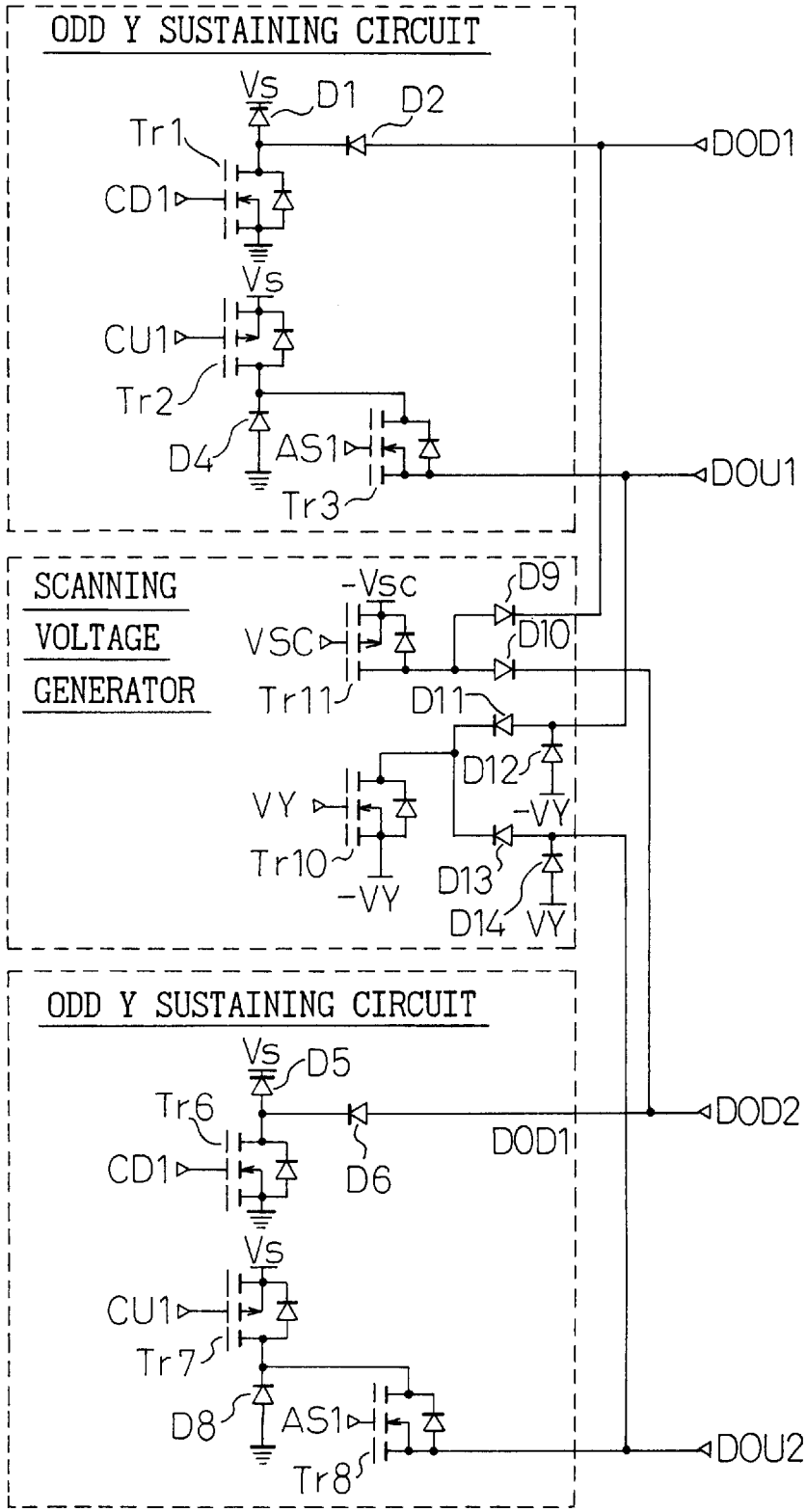
FIG. 10 is a diagram showing a detailed configuration of the Y-electrode drive circuit in accordance with the fourth embodiment.

FIG. 10 is a diagram showing the circuitry of a portion including the scan voltage generator 61, odd Y sustaining circuit 16, and even Y sustaining circuit 17 of the fourth embodiment. The scan voltage generator 61 has a transistor Tr10 to which a signal VY, used to produce a selection potential −VY during an addressing operation, is applied through a gate thereof, a transistor Tr11 to which a signal VSC, used to produce a non-selection potential −VSC during the addressing operation, is applied through the gate thereof, and diodes D9 to D14. Moreover, the transistors Tr4, Tr5, Tr9, Tr10, and diodes D3 and D7 are excluded from the odd Y sustaining circuit 16 and even Y sustaining circuit 17. Thus, two transistors can be eliminated.

The first to fourth embodiments have been described as embodiments in which the Y-electrode drive circuit is innovated. Next, embodiments in which the X-electrode drive circuit is innovated will be described. In the conventional PDP in which odd-numbered X electrodes and even-numbered X electrodes are not driven separately, the X electrodes are connected in common in the panel 1. Only one connection terminal is therefore included for simply connecting the output port of the X-electrode drive circuit to the X electrodes. However, in a PDP to which the present invention is adapted, different driving signals must be applied to the odd-numbered X electrodes and even-numbered X electrodes respectively.

Figure 11:
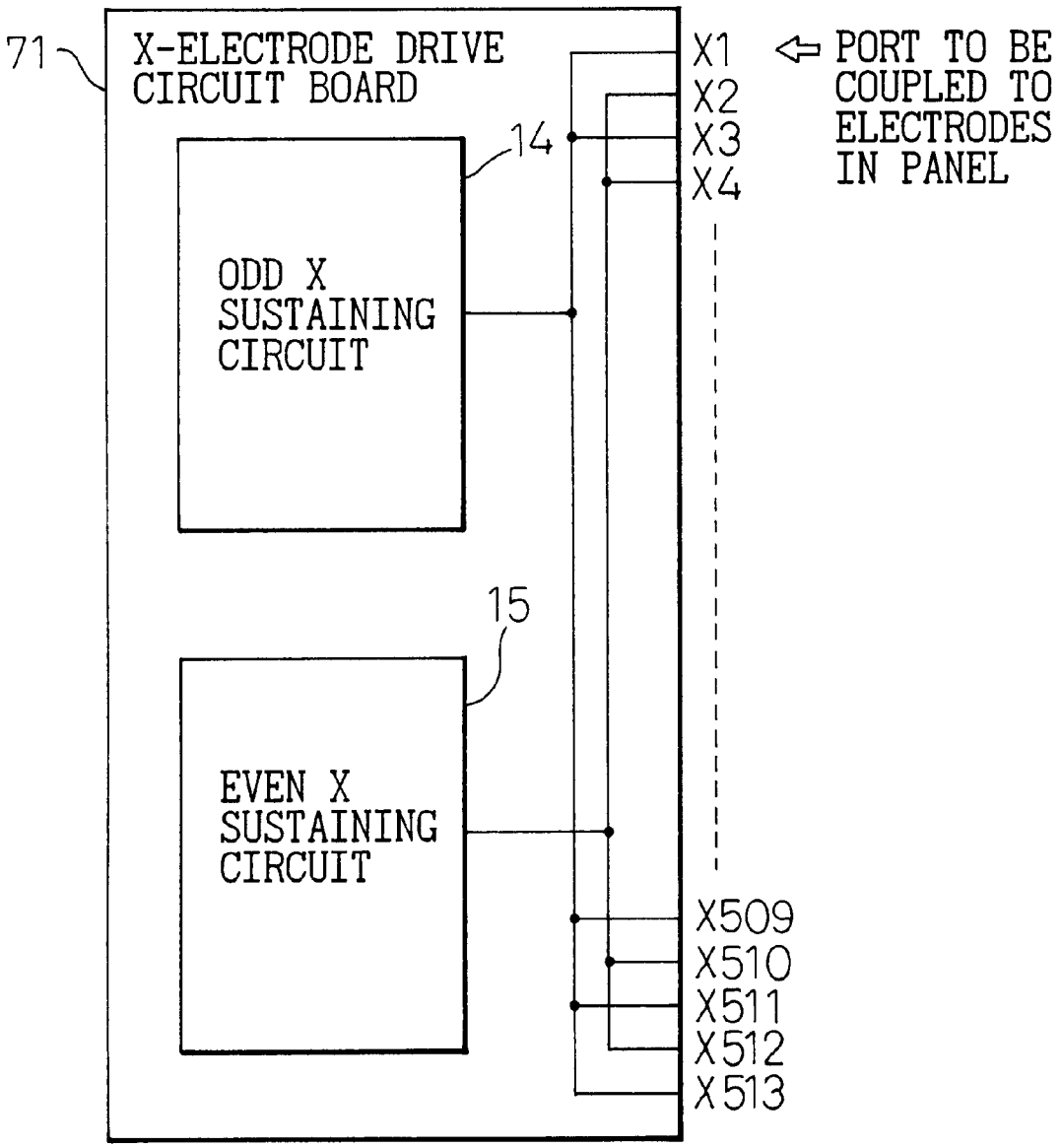
FIG. 11 is a diagram showing a configuration of an X-electrode drive circuit in accordance with the prior art.

FIG. 11 is a diagram showing the configuration of an X-side drive circuit board 71 on which a conventional X-electrode drive circuit is mounted. In this prior art, connection terminals to be coupled to X electrodes are lined up on the panel 1 in order of arrangement of the X electrodes. An output port of the X-side drive circuit board 71 includes a corresponding number of connection terminals. Outputs of the odd X sustaining circuit 14 and even X sustaining circuit 15 are supplied alternately through the connection terminals.

Figure 12:
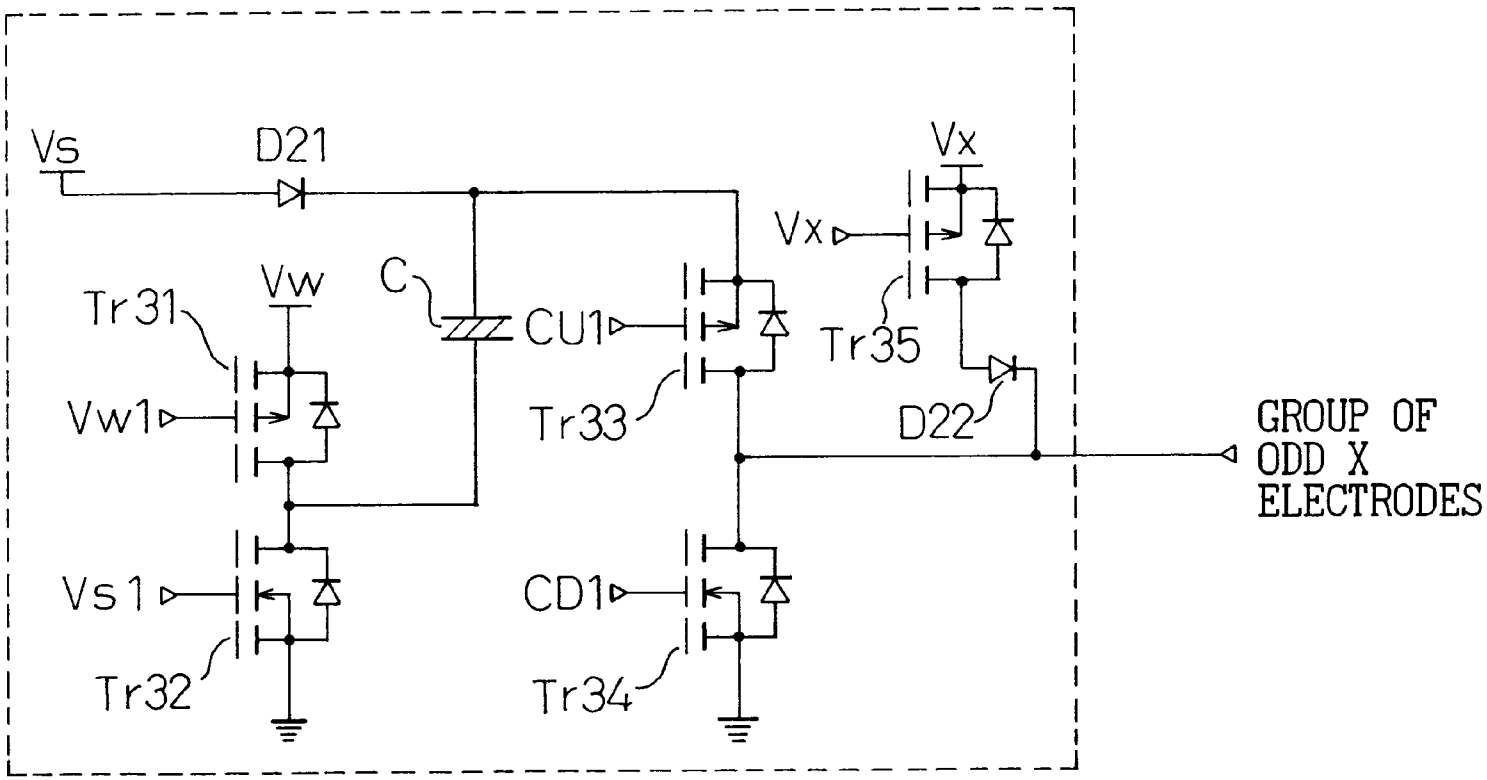
FIG. 12 is a diagram showing a configuration of an odd X sustaining circuit in accordance with the prior art.

FIG. 12 is a diagram showing the configuration of the odd X sustaining circuit 14. The even X sustaining circuit 15 has the same configuration. A sustaining pulse is applied from a Vs source to X electrodes in the panel 1 by way of a diode D21 and transistor Tr33. A discharge current flows along the same path. Moreover, the pulse is removed from Y electrodes to the ground through a transistor Tr1. When a transistor Tr31 is turned on, a voltage Vs accumulated in a capacitor C is added to a voltage Vw. This results in a writing voltage to be used for reset. The writing voltage is applied to the X electrodes via a transistor Tr2.

In the configuration shown in FIG. 11, the length of the line linking the odd X sustaining circuit 14 to the connection terminal X513 and the length of the line linking the even X sustaining circuit 15 to the connection terminal X2 are so long as to cause a problem of a voltage drop or the like.

Figure 13:
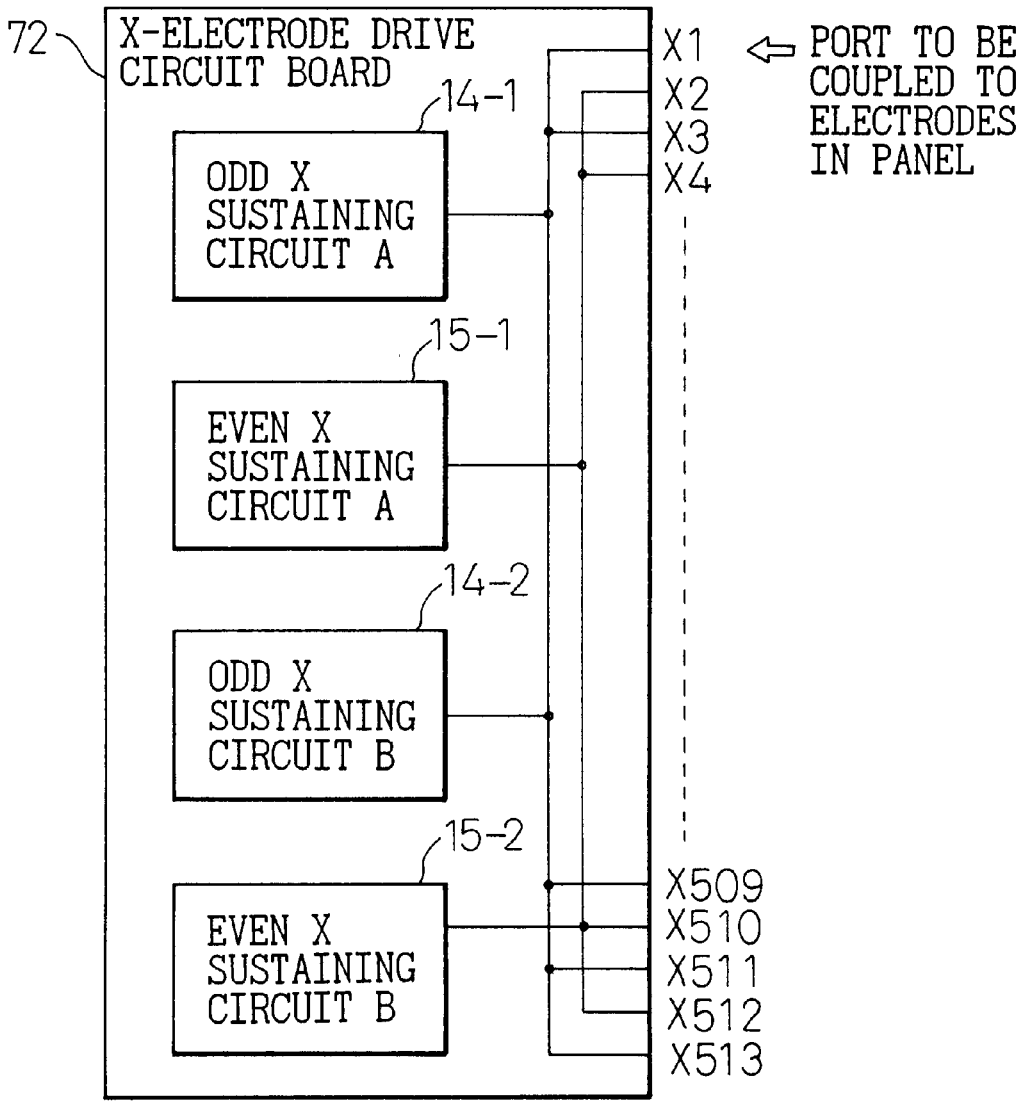
FIG. 13 is a diagram showing a configuration of an X-electrode drive circuit in accordance with the fifth embodiment of the present invention.

FIG. 13 is a diagram showing a configuration of an X-side drive circuit board 72 on which an X-electrode drive circuit of the sixth embodiment is mounted. The odd X sustaining circuit 14 is divided into two odd X sustaining circuits; an odd X sustaining circuit A 14-1 and odd X sustaining circuit B 14-2. The even X sustaining circuit 15 is divided into two even X sustaining circuits; an even X sustaining circuit A 15-1 and even X sustaining circuit B 15-2. This circuitry has alleviated the problem of a voltage drop deriving from wiring.

Figure 14A:
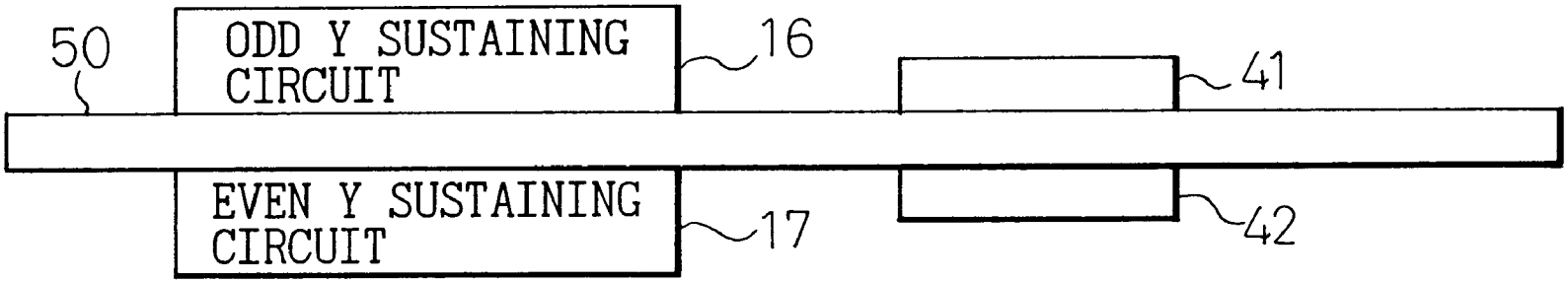
FIGS. 14A and 14B are diagrams showing examples of Y-electrode drive circuits mounted on a substrate.
Figure 14B:
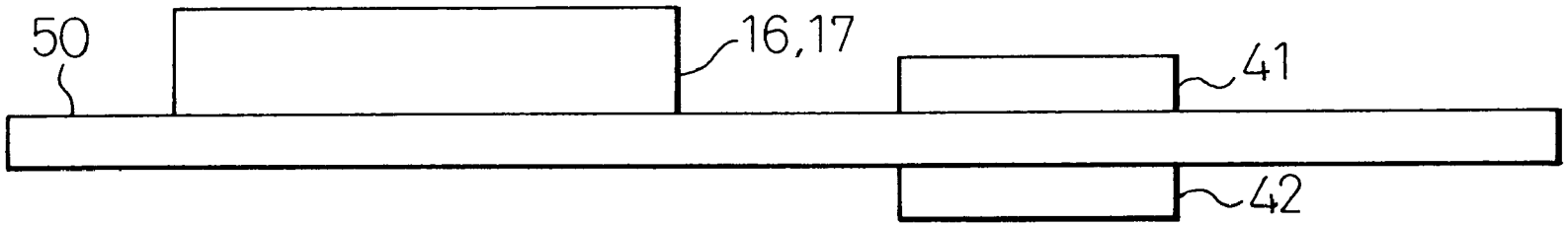

FIGS. 14A and 14B are diagrams showing examples of an Y-electrode drive circuit mounted on a circuit board. In FIG. 14A, an odd Y sustaining circuit 16 and a scan driver 41 to be connected to odd-numbered Y electrodes are mounted on one side of a substrate 50. An even Y sustaining circuit 17 and a scan driver 42 to be connected to even-numbered Y electrodes are mounted on the other side thereof. Owing to this arrangement, the area required to mount parts can be reduced. Besides, an output port of the scan driver 41 or 42 can be connected to Y-electrode connection terminals on a panel 1 through. the shortest distance. In particular, in a port to be coupled to the panel 1, terminals to be connected to the odd-numbered Y electrodes may be arranged on one side of the substrate. Terminals to be connected to the even-numbered Y electrodes may be arranged on the other side thereof. This obviates the necessity of rearranging lines on a circuit board.

FIG. 14B shows an example in which a scan driver 41 and scan driver 42 are arranged on opposite sides of a substrate. Even this arrangement makes it possible to connect the output ports of the scan drivers 41 and 42 to the Y-electrode connection terminals on the panel 1 at the shortest distance. Besides, there is an advantage that rearrangement of lines on a circuit board is unnecessary.

As described so far, drive circuits, for a PDP which can offer high-definition even though it is not finely structured, can be realized at low cost and-in a small size.

What is claimed is:

1. A plasma display device having a display panel with first and second electrodes arranged in parallel with one another, and third electrodes arranged orthogonally to the first and second electrodes, discharge cells being selected with a scanning signal and an addressing signal to be applied to the second and third electrodes, the selected cells being caused to sustain discharge by applying sustaining discharge signals to the first and second electrodes respectively, sustaining discharge signals that are mutually out of phase being applied alternately to adjoining ones of the first electrodes and adjoining ones of the second electrodes, whereby first display cells, being defined between second electrodes and first electrodes on one side of the second electrodes, and second display cells, being defined between second electrodes and first electrodes on the other side of the second electrodes are interlaced, where the first display cells and second display cells are allowed alternately and repeatedly to glow for display, said plasma display device comprising a drive circuit driving the second electrodes in said plasma display device, said drive circuit comprising:

a first drive circuit outputting a pulsating voltage to be applied in common to odd-numbered ones of the second electrodes;

a second drive circuit outputting a pulsating voltage to be applied in common to even-numbered ones of the second electrodes; and a plurality of third circuits, associated with the second electrodes, applying the pulsating voltages output from said first drive circuit and said second drive circuit to the second electrodes, and applying the scanning signal selectively to the second electrodes, said plurality of third circuits comprising:

a plurality of third odd circuits connected to the odd-numbered ones of the second electrodes, and a plurality of third even circuits connected to the even-numbered ones of the second electrodes, wherein said third odd circuits are integrated into one or more chips, and said third even circuits are integrated into one or more chips that are different from the one or more chips into which said third odd circuits are integrated.

2. A plasma display device according to claim 1, wherein the one or more chips containing said third odd circuits are located near said first drive circuit, and [said chip] the one or more chips containing said third even circuits are located near said second drive circuit.

3. A plasma display device according to claim 1, wherein said first and second drive circuits comprise a plurality of first and second drive circuits, and said plurality of first and second drive circuits are arranged alternately.

4. A plasma display device according to claim 3, wherein said third odd circuits and said third even circuits are each formed on a plurality of and arranged alternately while being associated with said plurality of first and second drive circuits.

5. A plasma display device according to claim 1, further comprising a fourth circuit supplying a selection voltage equivalent to the scanning signal, and supplying a non-selection voltage to be applied to the second electrodes other than those to which the scanning signal is applied, wherein the selection voltage and the non-selection voltage are supplied from said fourth circuit to said third odd circuits and said third even circuits.

6. A plasma display device according to claim 5, wherein said fourth circuit comprises:

a first switching element applying the selection voltage;

a first diode and a second diode connected to said first switching element;

a second switching element supplying the non-selection voltage; and a third diode and a fourth diode connected to said second switching element, wherein said first diode is connected to one terminal of each of said third odd circuits, said third diode is connected to the other terminals of said third odd circuits, said second diode is connected to one terminal of each of said third even circuits, and said fourth diode is connected to the other terminals of said third even circuits.

7. A plasma display device according to claim 1, wherein said first and second drive circuits each comprise at least a switching element supplying a sustaining discharge voltage and a switching element supplying a voltage to be applied selectively to the second electrodes at the time of application of the scanning signal.

8. A plasma display device according to claim 1, further comprising a substrate, said substrate having said first drive circuit and the one or more chips containing said third odd circuits mounted on one side thereof, and said second drive circuit and the one or more chips containing said third even circuits mounted on the other side thereof.

9. A plasma display device according to claim 1, further comprising a substrate, said substrate having the one or more chips containing said third odd circuits mounted on one side thereof, the one or more chips containing said third even circuits mounted on the other side thereof, and said first and second drive circuits mounted on either one of the sides of the substrate.

10. A plasma display device according to claim 8, wherein output terminals on the one or more chips containing said third odd circuits and on the one or more chips containing said third even circuits, through which the scanning signal is output sequentially, are arranged so that the scanning signal is output in the same direction with respect to one side of said substrate.

11. A plasma display device according to claim 9, wherein output terminals on the one or more chips containing said third odd circuits and on the one or more chips containing said third even circuits, through which the scanning signal is output sequentially, are arranged so that the scanning signal is output in the same direction with respect to one side of said substrate.

* * * * *

UNITED STATES PATENT AND TRADEMARK OFFICE

CERTIFICATE OF CORRECTION

PATENT NO. : 6,603,446 B1 
DATED : August 5, 2003
INVENTOR(S) : Yoshikazu Kanazawa et al.

It is certified that error appears in the above-identified patent and that said Letters Patent is hereby corrected as shown below:

Column 13,
Line 23, after "plurality of" insert -- chips --.

Signed and Sealed this

Thirtieth Day of December, 2003

JAMES E. ROGAN
*Director of the United States Patent and Trademark Office*